US011493303B1

(12) United States Patent
Drake

(10) Patent No.: US 11,493,303 B1
(45) **Date of Patent: *Nov. 8, 2022**

(54) FIREARM LASER SIGHT

(71) Applicant: Dustin Drake, Boca Raton, FL (US)

(72) Inventor: Dustin Drake, Boca Raton, FL (US)

( * ) Notice: Subject to any disclaimer, the term of this patent is extended or adjusted under 35 U.S.C. 154(b) by 0 days.

This patent is subject to a terminal disclaimer.

(21) Appl. No.: 17/207,427

(22) Filed: Mar. 19, 2021

Related U.S. Application Data

(63) Continuation-in-part of application No. 16/517,555, filed on Jul. 20, 2019, now Pat. No. 10,955,218.

(60) Provisional application No. 62/703,163, filed on Jul. 25, 2018.

(51) Int. Cl.
*F41G 1/14* (2006.01)
*F41G 1/34* (2006.01)
*F41G 1/36* (2006.01)

(52) U.S. Cl.
CPC ..... *F41G 1/14* (2013.01); *F41G 1/345* (2013.01); *F41G 1/36* (2013.01)

(58) Field of Classification Search
CPC ..... F41G 1/32; F41G 1/34; F41G 1/35; F41G 1/36; F41G 1/027; F41G 1/545; F41G 11/004
USPC ..... 42/114, 115, 117, 146
See application file for complete search history.

(56) References Cited

U.S. PATENT DOCUMENTS 10,955,218 B1 * 3/2021 Drake ..... F41G 11/004

* cited by examiner

*Primary Examiner* — Bret Hayes
(74) *Attorney, Agent, or Firm* — John Rizvi; John Rizvi, P.A.—The Patent Professor

(57) ABSTRACT

An improved firearm laser sight comprising a pattern generating element and an enlarging lens for enhanced projection of sight patterns onto an intended target is disclosed. The device is meant to be an accessory for firearms of all types by comprising any standardized methods for attachment, and may serve to decrease the time needed to acquire an intended target before firing. The device may implement a variety of sight patterns that may be projected larger and in a more pronounced way, when compared to standard firearm sights, to provide a clear image that may be quickly acquired even over longer distances. The improved firearm laser sight may be made available with a red or green visible laser, an infrared laser, or an ultraviolet light depending on the intended use of the device.

20 Claims, 13 Drawing Sheets

FIREARM LASER SIGHT

CROSS-REFERENCE TO RELATED APPLICATION

This application claims the benefit of co-pending U.S. patent application Ser. No. 16/517,555, filed Jul. 20, 2019, which claims the benefit of U.S. Provisional Patent Application Ser. No. 62/703,163, filed Jul. 25, 2018, each of which are incorporated herein in their entirety.

FIELD OF THE INVENTION

The present invention relates generally to firearms attachments, and more particularly, to an improved firearm laser sight.

BACKGROUND OF THE INVENTION

A firearm sight is an aiming device used to assist in visually aligning ranged weapons onto an intended target. One type of firearm sight is a reflector sight, or a reflex sight, which may be an optical device comprising a reflecting glass element and an illuminated projection of an aiming point superimposed on the field of view. One specific type of reflector sight is a red dot sight, which may be a non-magnifying sight comprising a light-emitting diode (LED) at the focus of collimating optics that may generate a dot-style illuminated reticle that stays in alignment with the weapon to which it is attached regardless of eye position. Such sights may assist in target acquisition speed and tracking of moving targets, though require a user of the firearm to be viewing the intended target through the sight itself as no visual indication of aim is being projected beyond the sight hardware.

By contrast, a laser sight is a type of firearm sight that may comprise a visible-light laser, infrared laser, or a combination thereof to project a beam of light parallel to the barrel of the weapon to which it is attached. Such a beam of light may be viewed by a user of the weapon without viewing the intended target through the sight itself. Such a device provides the advantage of allowing a user of the weapon to remain focused on the intended target regardless of the weapon's position. However, the use of laser beams causes the visibility of the beam of light to be problematic (e.g., too large, low brightness) at long distances. Such sizing of a conventional laser dot, especially at long distances, may result in a user of the weapon having difficulty in finding the laser dot being projected from their weapon. Further, in sights where multiple conventional laser dots are used, the dots become skewed on angled targets, especially at long distances.

Therefore, there is a need in the art for a sight that improves on the ability to show precisely where a single projectile will hit at a time on flat, angled, or uneven surfaces, and at long distances.

SUMMARY OF THE INVENTION

This summary is provided to introduce a selection of concepts in a simplified form that are further described below in the detailed description. This summary is not intended to identify key or essential features of the claimed subject matter, nor is it intended to be used to limit the scope of the claimed subject matter. Furthermore, the claimed subject matter is not limited to implementations that solve any or all disadvantages noted in any part of this disclosure.

According to embodiments or examples of the present disclosure, an improved firearm laser sight is disclosed.

In one aspect, the improved firearm laser sight may comprise a main housing, mounting adapter, locking configuration, focusing lens, pattern generating element, collimating lens, light source, and power source.

In another aspect, the improved firearm laser sight may comprise a rail mount system.

In another aspect, the improved firearm laser sight may comprise a barrel mount system.

In another aspect, the improved firearm laser sight may comprise a pattern generating element adjustment configuration.

In another aspect, the improved firearm laser sight may comprise a removably attached pattern generating element.

In another aspect, the improved firearm laser sight may comprise a visible laser.

In another aspect, the improved firearm laser sight may comprise an infrared laser.

In another aspect, the improved firearm laser sight may comprise a constant beam laser.

In another aspect, the improved firearm laser sight may comprise a pulsing beam chip that controls a current going to a laser, thereby being able to create a pulsing effect by switching the current on and off. The pulsing beam function may be enabled through a switch or button, and the switch or button may be the same switch or button as a power switch or button which could be programmed for different functions based on how long or how many times the switch or button is pressed.

In another aspect, the improved firearm laser sight may comprise a power switch.

In another aspect, the improved firearm laser sight may comprise a capacitive touch switch.

In another aspect, the improved firearm laser sight may comprise Airy beam technology.

In another aspect, the improved firearm laser sight may comprise shadow mask technology.

Another example of an improved laser sight can include a main housing, a mounting adapter inside the main housing, a pattern generating element, a collimating lens, a light source, and a power source, a focusing lens, wherein light from the light source is aimed to pass through the collimating lens, the pattern generating element, and the focusing lens, wherein the focusing lens adjusts a size of an image projected from the laser sight such that the image is projected with minimal spread over distance projected.

In another aspect, the pattern generating element may be a diffractive optical element.

In another aspect, the pattern generating element may be a shadow mask.

In another aspect, adjusting a position of one or more of the optical components may cause a spread over distance projected to be reduced or increased.

In another aspect, adjusting a position of one or more of the optical components may cause a size of a projected image within the housing to change.

In another aspect, adjusting a distance between the pattern generating element and the focusing lens can adjust a spread over distance projected to be reduced.

In another aspect, a pulsing beam may be used to reduce perceived shakiness of a projected image.

In another aspect, the focusing lens may be aspherical.

In another aspect, the focusing lens may be spherical.

In another aspect, the focusing lens is a Fresnel lens.

In another aspect, Airy beam technology may be used to project a sight pattern over long distances with minimum or no spread.

In another aspect, a sight pattern may be enlarged within the sight as much as possible within constraints of the main housing before passing through the focusing lens.

In another aspect, a sight pattern may be generated in the housing that exits the laser sight in a collimated fashion to reduce spread over traveled distances.

In another aspect, a capacitive touch system may be included to allow a user to operate the laser sight by simply touching the laser sight or any interconnected conductive portion of a weapon on which the laser sight is attached.

In another aspect, the pattern generating element may be replaceable with other pattern generating elements to change a projected pattern.

In another aspect, the light source may be a high powered laser requiring a cooling system, wherein the laser sight may include the cooling system.

In another aspect, the light source may be a high powered laser may requiring a cooling system, wherein the laser sight may include the cooling system, and the cooling system may comprise an active cooling system.

In another aspect, the light source may be a high powered laser may requiring a cooling system, wherein the laser sight may include the cooling system, and cooling system may comprise a passive cooling system.

These and other objects, features, and advantages of the present invention will become more readily apparent from the attached drawings and the detailed description of the embodiments or examples, which follow.

BRIEF DESCRIPTION OF THE DRAWINGS

The embodiments and examples of the claimed subject matter will hereinafter be described in conjunction with the appended drawings provided to illustrate and not to limit the scope of the claimed subject matter, where like designations denote like elements, and in which:

It is to be understood that like reference numerals refer to like parts throughout the several views of the drawings.

DETAILED DESCRIPTION

The following detailed description is merely exemplary in nature and is not intended to limit the described embodiments or examples of the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to make or use the embodiments of the disclosure and are not intended to limit the scope of the disclosure, which is defined by the claims. Furthermore, there is no intention to be bound by any expressed or implied theory presented in the preceding technical field, background, brief summary, or the following detailed description. It is also to be understood that the specific devices and processes illustrated in the attached drawings, and described in the following specification, are simply exemplary embodiments of the inventive concepts defined in the appended claims. Hence, specific dimensions and other physical characteristics relating to the embodiments disclosed herein are not to be considered as limiting, unless the claims expressly state otherwise.

Figure 1:
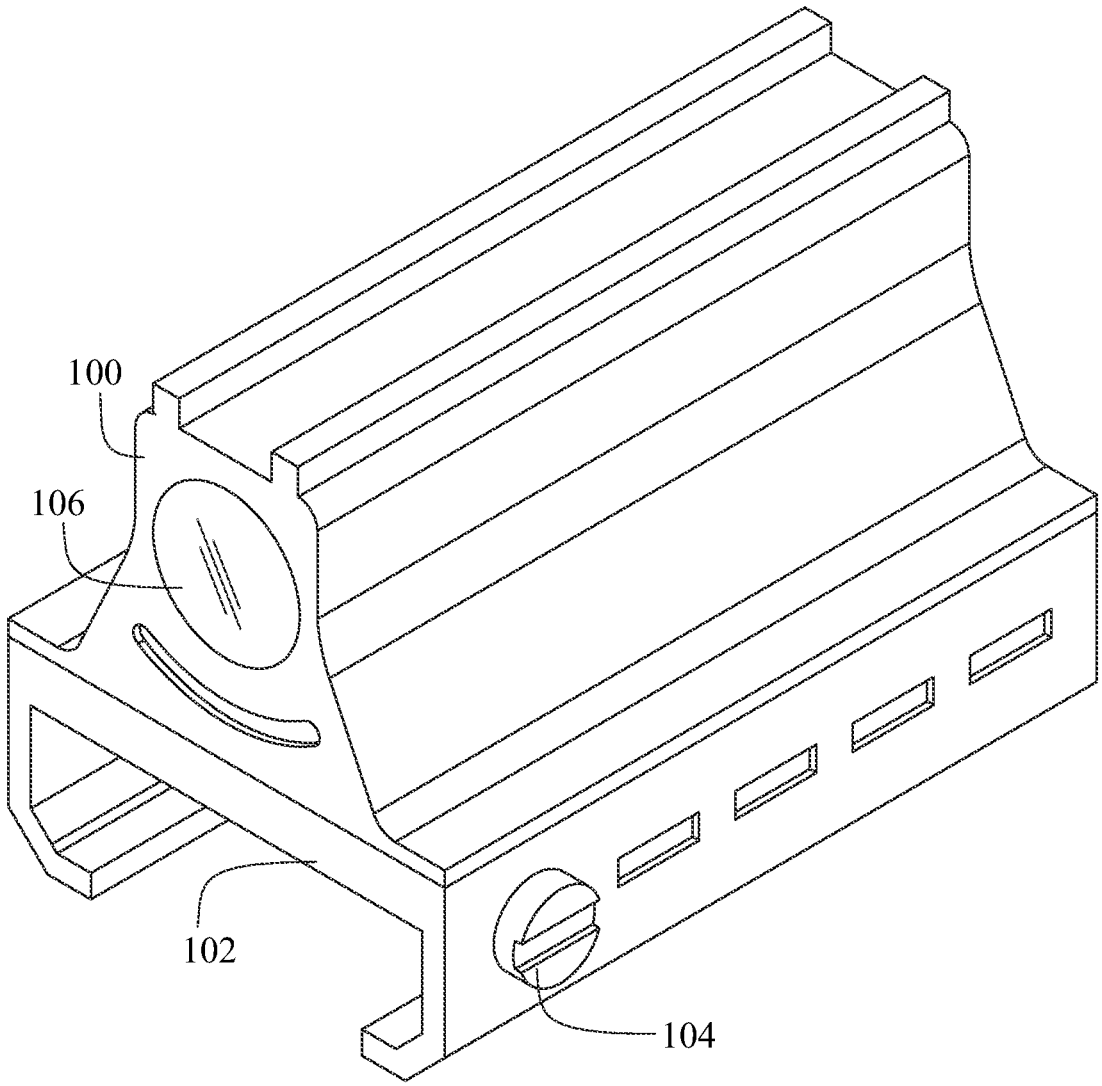
FIG. 1 illustrates a top perspective view of a first example of an improved firearm laser sight, in accordance with aspects of the present disclosure.

The illustration of FIG. 1 illustrates an overall view of a first example of an improved firearm laser sight. Particularly identified in the image are a main housing 100, a mounting adapter 102, and a locking configuration 104. The main housing 100 may be designed to enclose the entirety of components required to project a laser beam, as contemplated by the present invention, and may be made from any suitable material such as polymers, stainless steel, aluminum, carbon fiber, fiberglass, or any combination thereof. The mounting adapter 102 may comprise any of a variety of standardized mounting adapters common in the firearms industry, such as a Weaver rail, Picatinny rail, or barrel mount, and may be made from any suitable material consistent with the composition of the main housing 100 for aesthetic considerations. The locking configuration 104 may be any type of locking mechanism suitable to the choice of mounting adapter 102, such as screws, hex bolts, or lever locks, and may be made from any suitable material consistent with the composition of the main housing 100 and mounting adapter 102 for aesthetic considerations. Also identified in the image is a focusing lens 106, which may be an aspherical, spherical, Fresnel, or other appropriate lens to adjust the size of the image projected from the device.

Figure 2:
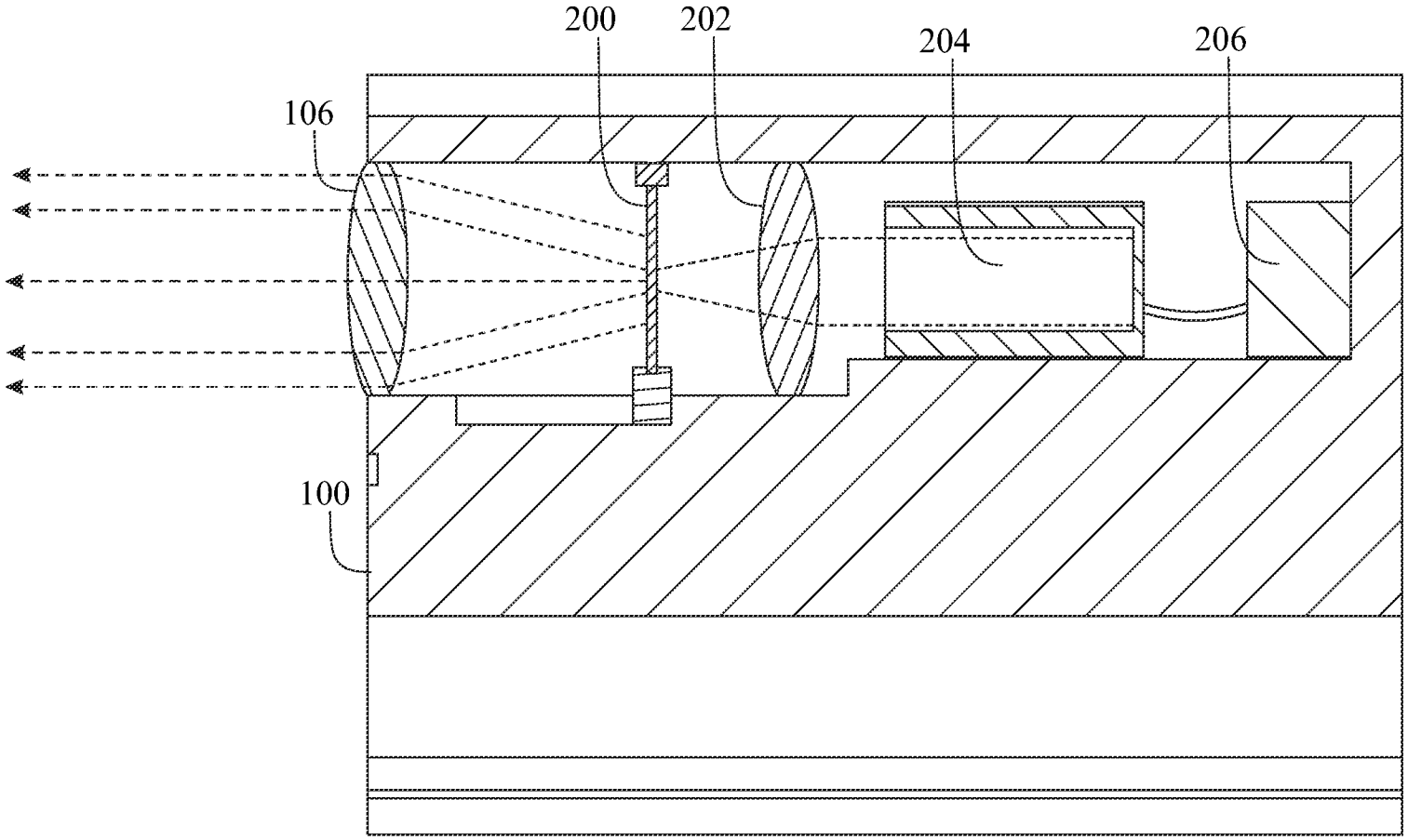
FIG. 2 illustrates a cross-sectional view of a first example of an improved firearm laser sight, in accordance with aspects of the present disclosure.
Figure 3:
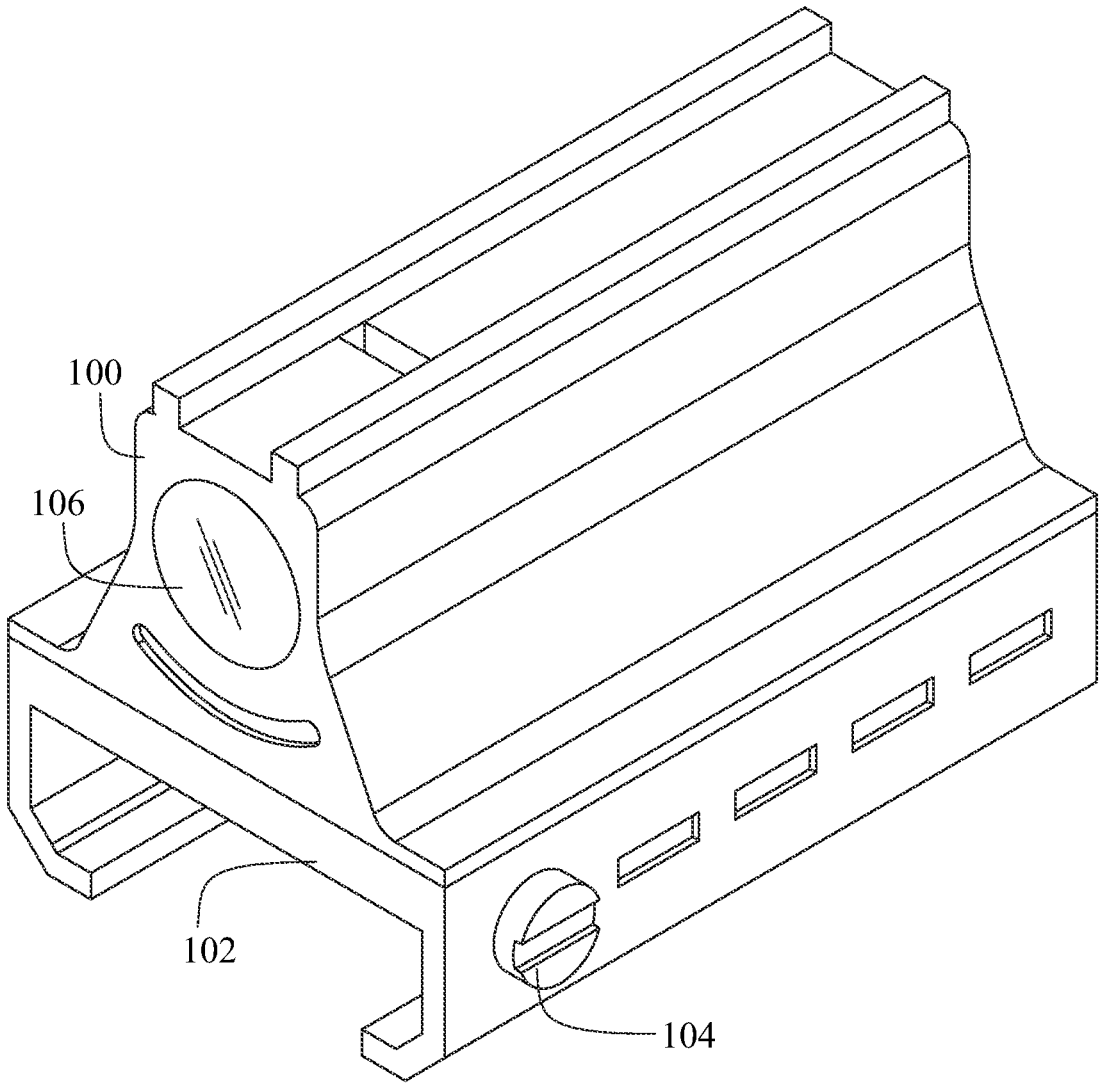
FIG. 3 illustrates top perspective view of a second example of an improved firearm laser sight, including a removably attachable pattern generating element, in accordance with aspects of the present disclosure.
Figure 4:
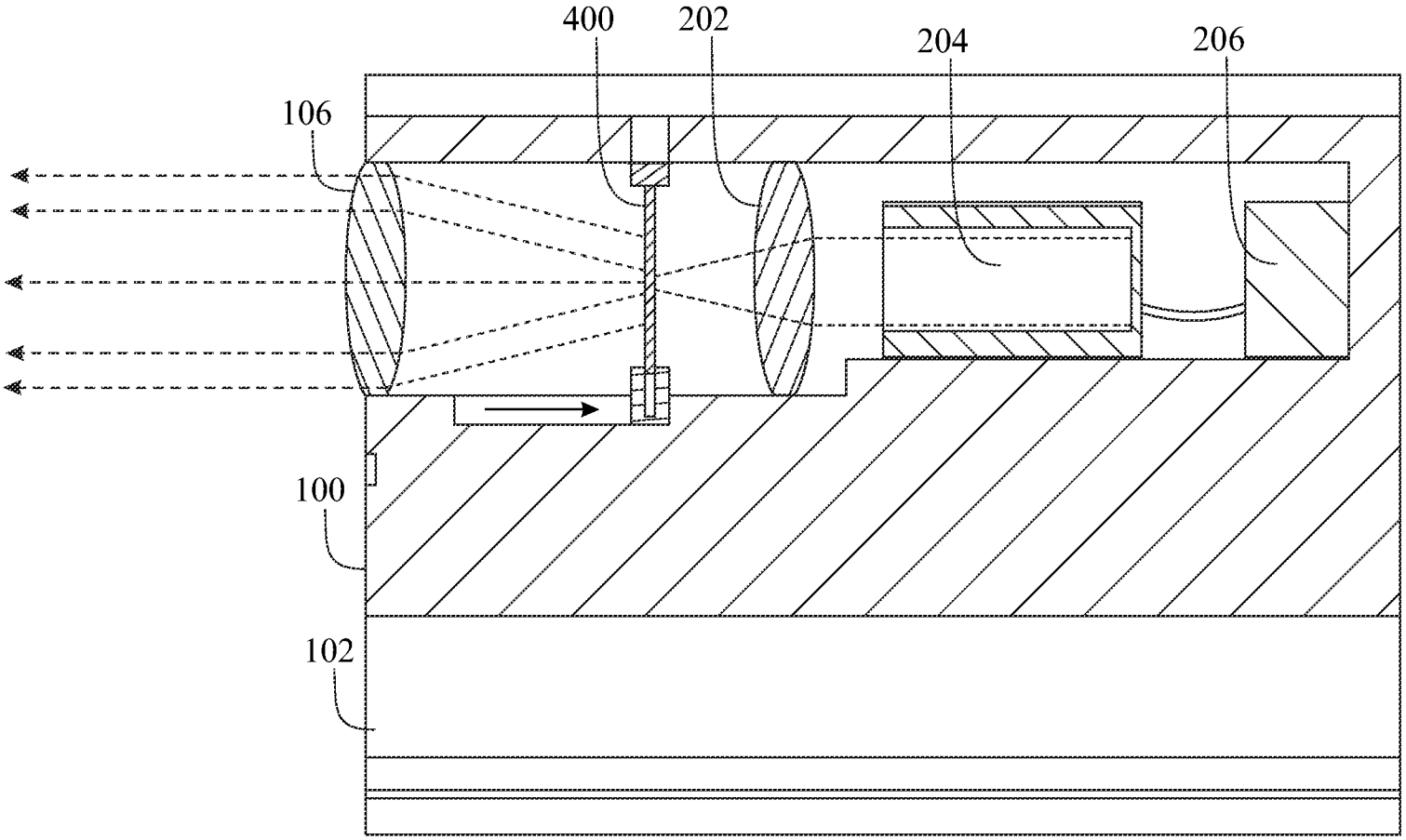
FIG. 4 illustrates a cross-sectional view of a first configuration of the second example of an improved firearm laser sight shown in FIG. 3, in accordance with aspects of the present disclosure.
Figure 5:
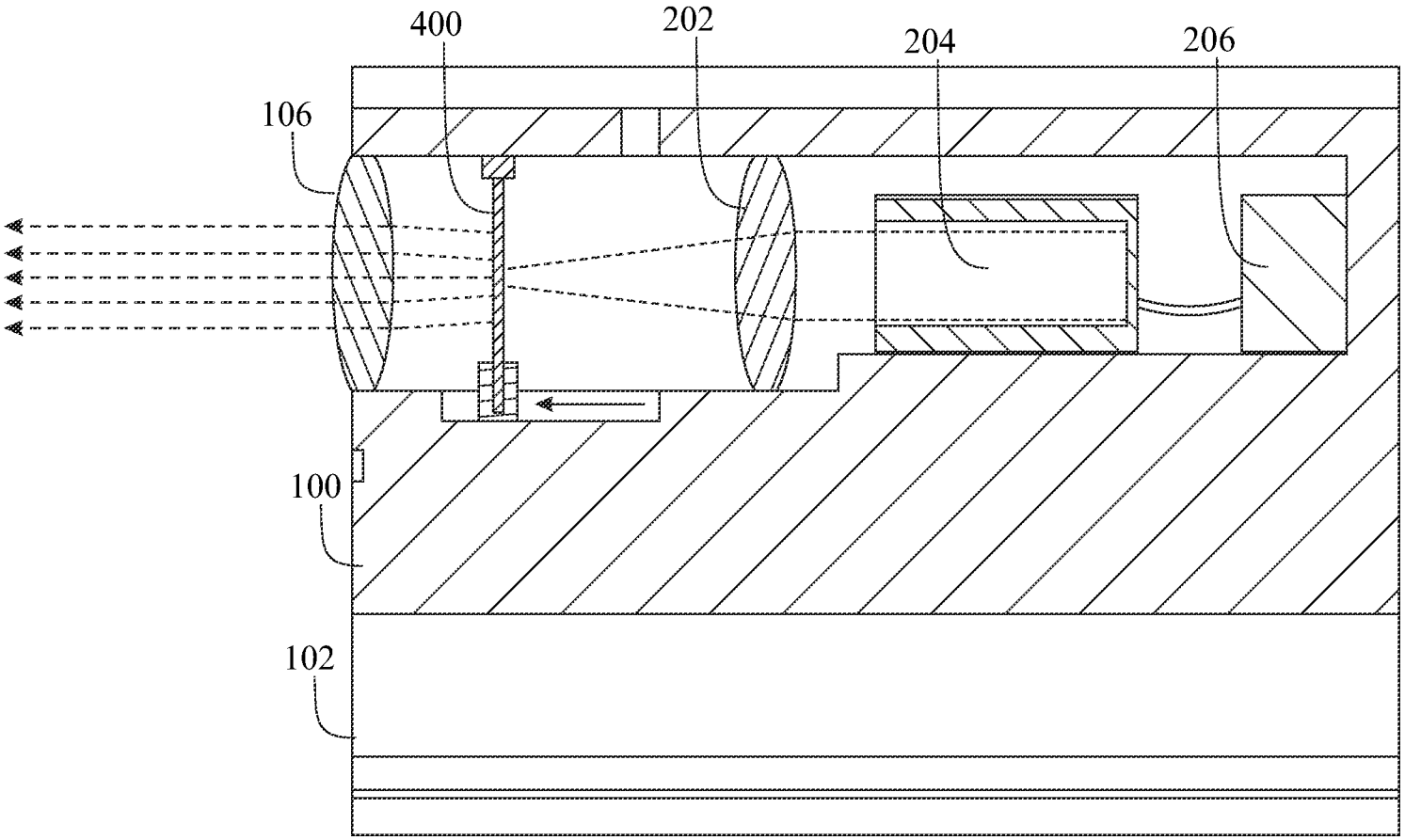
FIG. 5 illustrates a cross-sectional view of a second configuration of the second example of an improved firearm laser sight shown in FIG. 3, in accordance with aspects of the present disclosure.
Figure 6:
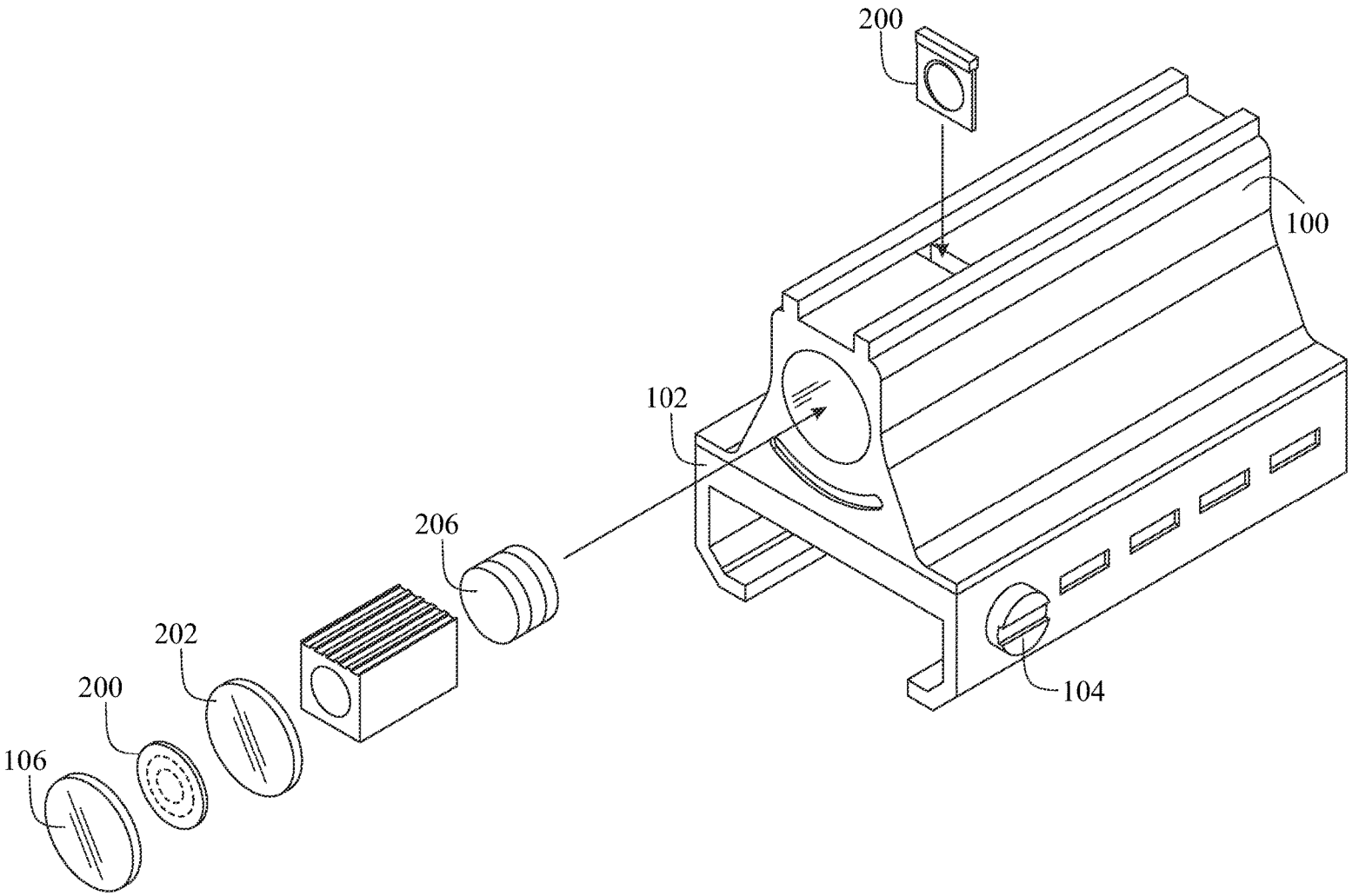
FIG. 6 illustrates an exploded parts view of the second example of an improved firearm laser sight where a relative orientation of internal components may be visualized, in accordance with aspects of the present disclosure.
Figure 7:
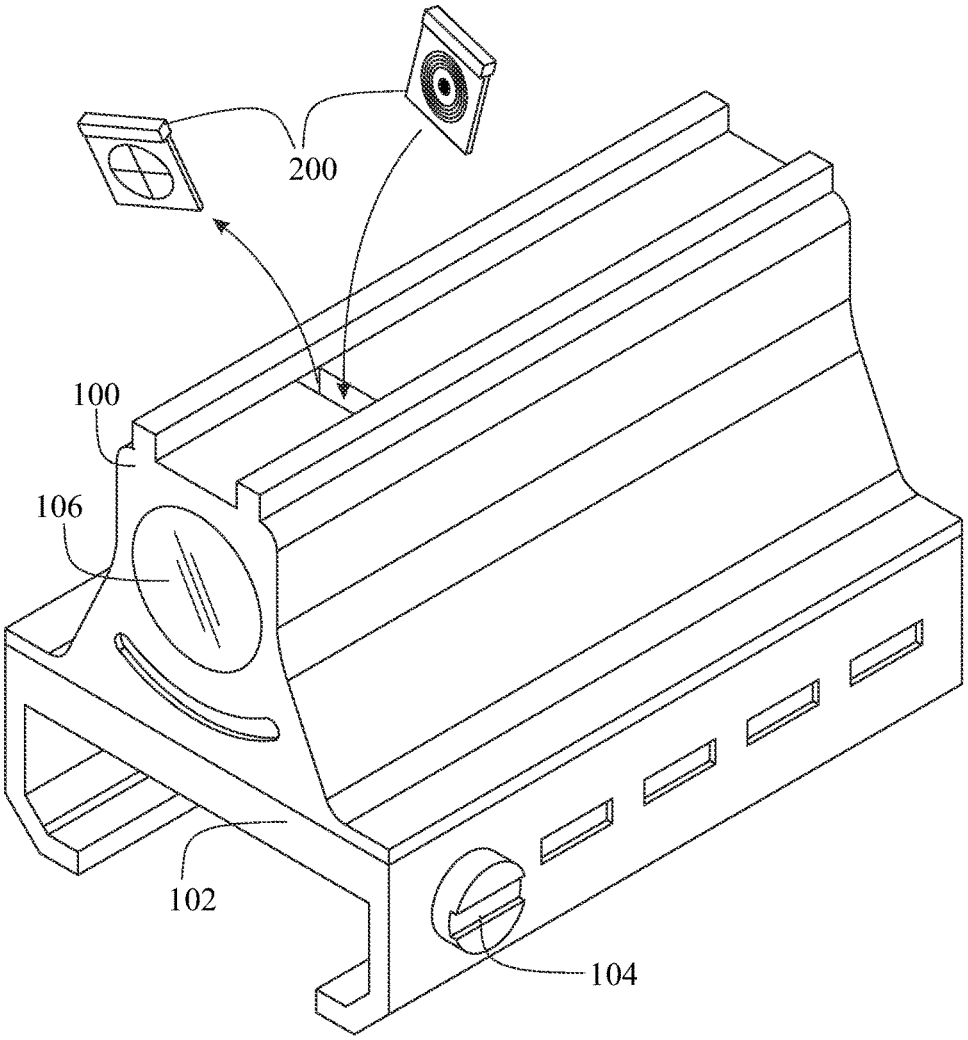
FIG. 7 illustrates a top perspective view of a second example of an improved firearm laser sight where a first pattern generating element is being swapped for a second pattern generating element, in accordance with aspects of the present disclosure.

The illustration of FIG. 2 illustrates a cross-sectional view of a first example of an improved firearm laser sight showing a main housing 100, mounting adapter 102, focusing lens 106, and the relative orientation of internal components within the main housing 100. The internal components comprise a pattern generating element 200, such as, by way of example only, a diffractive optical element, a shadow mask, etc., a collimating lens 202, a light source 204, and a power source 206. The power source 206, which may comprise a plurality of batteries, provides power to the light source 204, which may comprise a visual laser, infrared laser, or ultraviolet light. The light source 204 may transmit light towards a front end of a main housing 100, either by a constant beam or a pulsing beam, which may be oriented towards a front end of a weapon to which it is attached. A pulsing beam may be useful to provide a more stable sight (reducing shakiness). The light may first pass through a collimating lens 202 so that it may be appropriately focused on a pattern generating element 200. The light may pass through the pattern generating element 200 to cause the light to be shaped into a sight pattern. In a first example of an improved firearm laser sight the pattern generating element 200 may be entirely enclosed within the main housing 100, such as is shown best in FIG. 2, though it may have an adjustable position or focal length via the implementation of an adjustment configuration extending to the outside of the main housing 100. For example, FIGS. 4 and 5 show how the pattern generating element 400 may be adjusted back and forth with respect to the focusing lens 106. More in particular, in at least one embodiment, the pattern generating element 400 is positionable between a furthest distance from the focusing lens 106 such that the size of the projected sight image is maximized, as shown best in the illustrative embodiment of FIG. 4, and a closer distance to the focusing lens 106 such that the size of the projected sight image is reduced, as shown best in the illustrative embodiment of FIG. 5. Moving the position of the pattern generating element 200, 400 relative to the focusing lens 106 may adjust the size of a projected sight image or pattern (P), and/or a spread of the image over long distances, such as is shown best in FIGS. 16A through 16C.

In some examples, the device may include an electronic circuit as opposed to a pulsing beam chip which serves multiple functions. The functions would include powering the device on or off, a pulsing mode, a dimming feature for changing the intensity of the beam, and a timer for automatically turning the device off. That circuit could be controlled by the buttons, or switches for the various functions based on how long or how many times they are pressed. It also may include more than one button or switch for these purposes.

The light, or sight pattern, may be enlarged as much as possible within the constraints of the main housing 100 before passing through the focusing lens 106. The light may exit the focusing lens 106 at an angle that permits the sight pattern to enlarge slowly over distance so that the image remains easily visible at longer distances. For example, the light or pattern may be enlarged as much as possible within the main housing 100 such that a substantially large and clear image is immediately projected out from the sight and focused such that the projected image does not get too large or too small over long distances, maintaining an appropriate size, brightness, and clarity as optimal to a human user over short and long distances. The projected pattern may be larger, clearer, more defined, and practically shaped than a typical laser dot. The projected pattern may appear to be more stable compared to a traditional laser dot because of its larger size. The projected pattern may be a design formed by clean lines and/or circles, as non-limiting examples. The sight may be configured such that the pattern may be projected such that when the pattern hits angled surfaces, the pattern is not significantly skewed. The projected pattern indicates where a projectile will hit a target.

The device may further comprise a power switch, which may be an on/off switch or a button, and which may permit the improved firearm laser sight to be turned on and off. The power switch may alternatively comprise a capacitive touch switch that permits the device to be turned on and off with a tap or touch, or while being touched. The device may further implement Airy beam technology to generate a constant size sight pattern that is larger than the constraints of the main housing 100. The device may further implement a shadow mask instead of a pattern generating element 200, which may produce a sharper, though dimmer, sight pattern.

The illustrations of FIGS. 3 through 7 illustrate a second example of an improved firearm laser sight. Such a second example may be otherwise similar to said first example in function and composition, though may instead comprise a removably attached pattern generating element 200, such as is shown best, by way of example, in the illustrative embodiment of FIG. 7. Such a design may permit a first pattern generating element with a first sight pattern to be swapped for a second pattern generating element configured to produce a second sight pattern, in accordance with at least one embodiment of the device.

Figure 8:
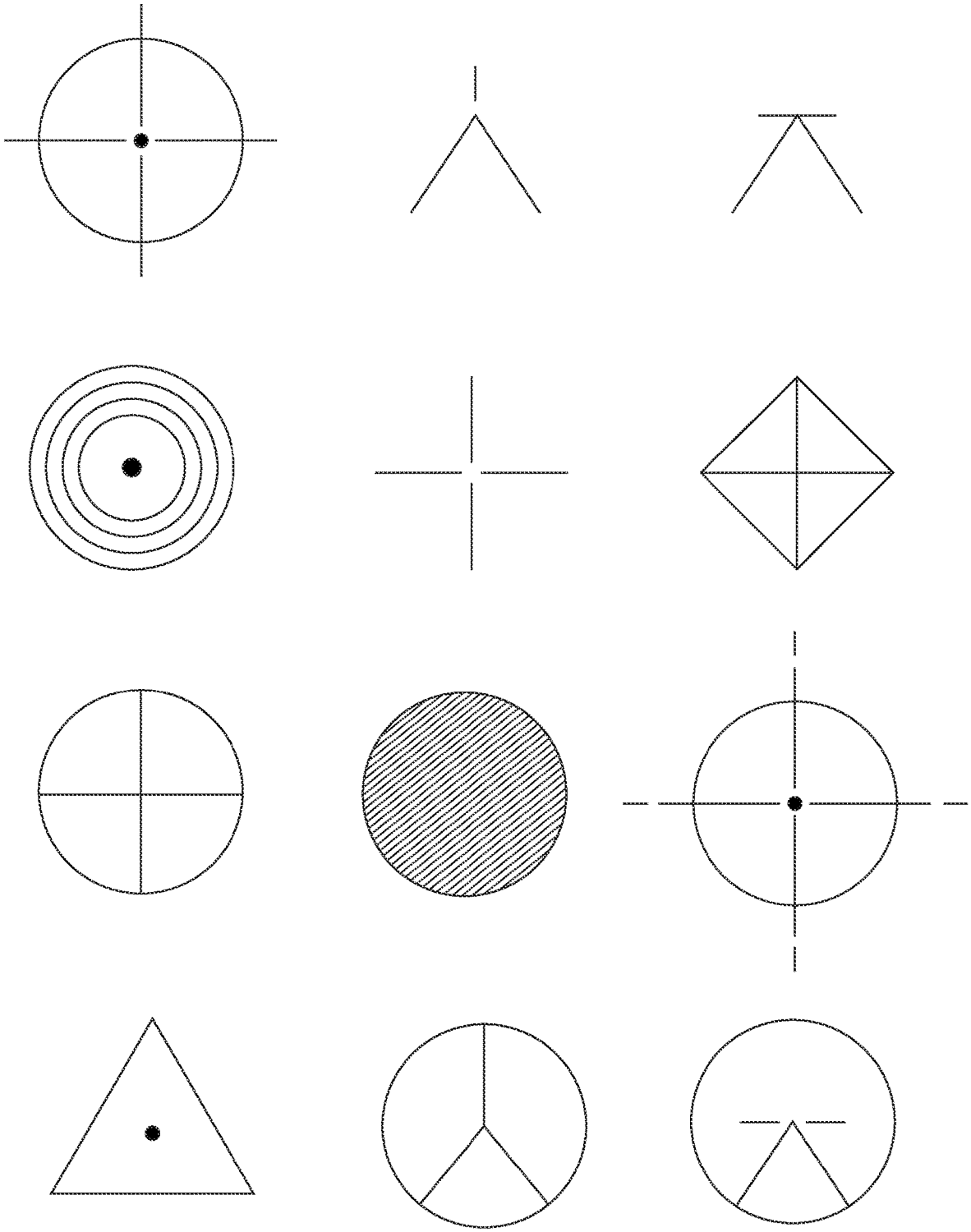
FIG. 8 illustrates a plurality of sight patterns that may be selected in an improved firearm laser sight, in accordance with aspects of the present disclosure.

The illustration of FIG. 8 illustrates a plurality of sight patterns that may be selected in an improved firearm laser sight. The selectable sight patterns may include, but are not limited to, crosshairs, crosshairs embedded within a ring, a series of rings, a ring with a dot in the center, a filled circle, chevrons, triangles, or any combination thereof.

Figure 9:
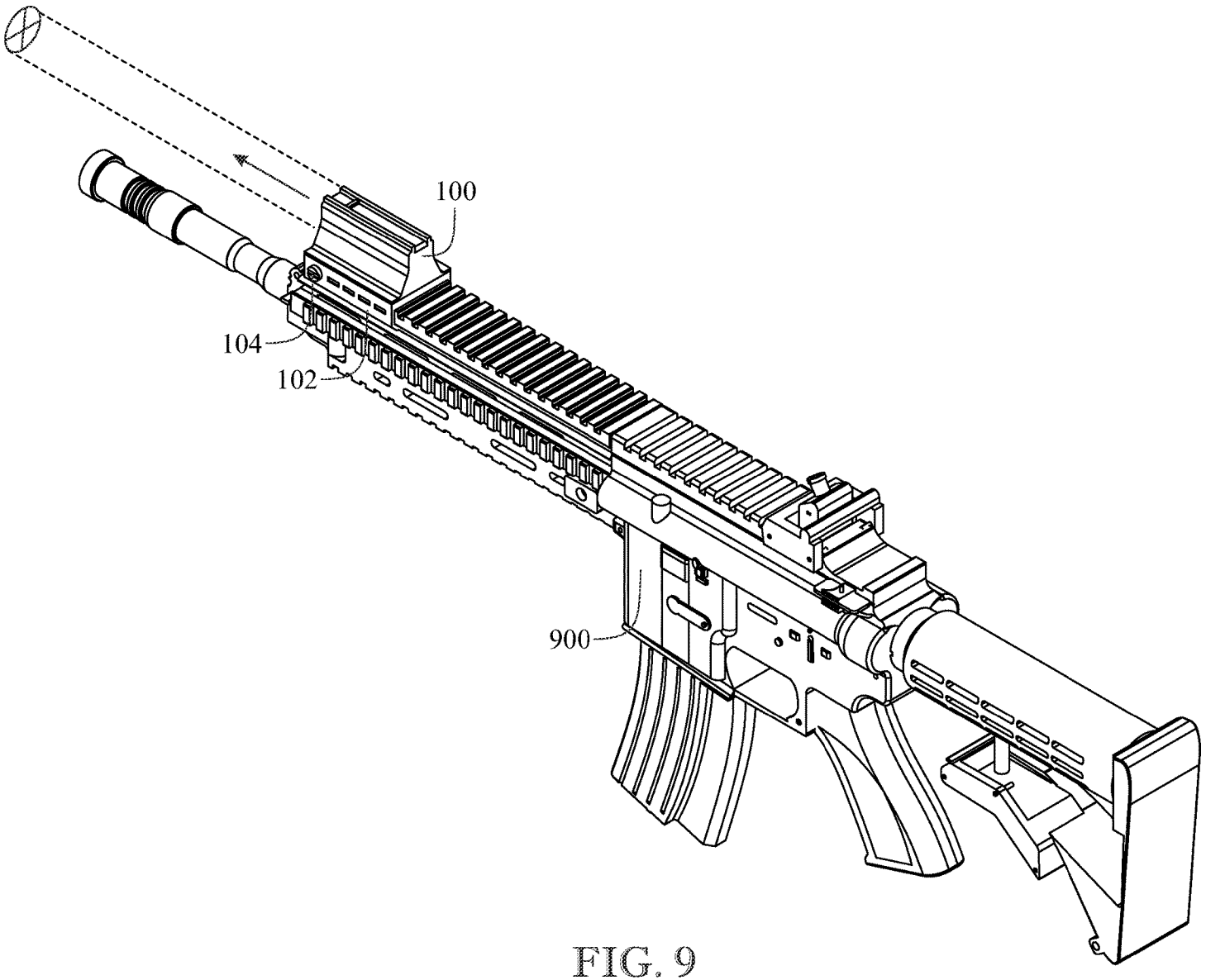
FIG. 9 illustrates a perspective view of an improved firearm laser sight mounted on an exemplary rifle, in accordance with aspects of the present disclosure.
Figure 10:
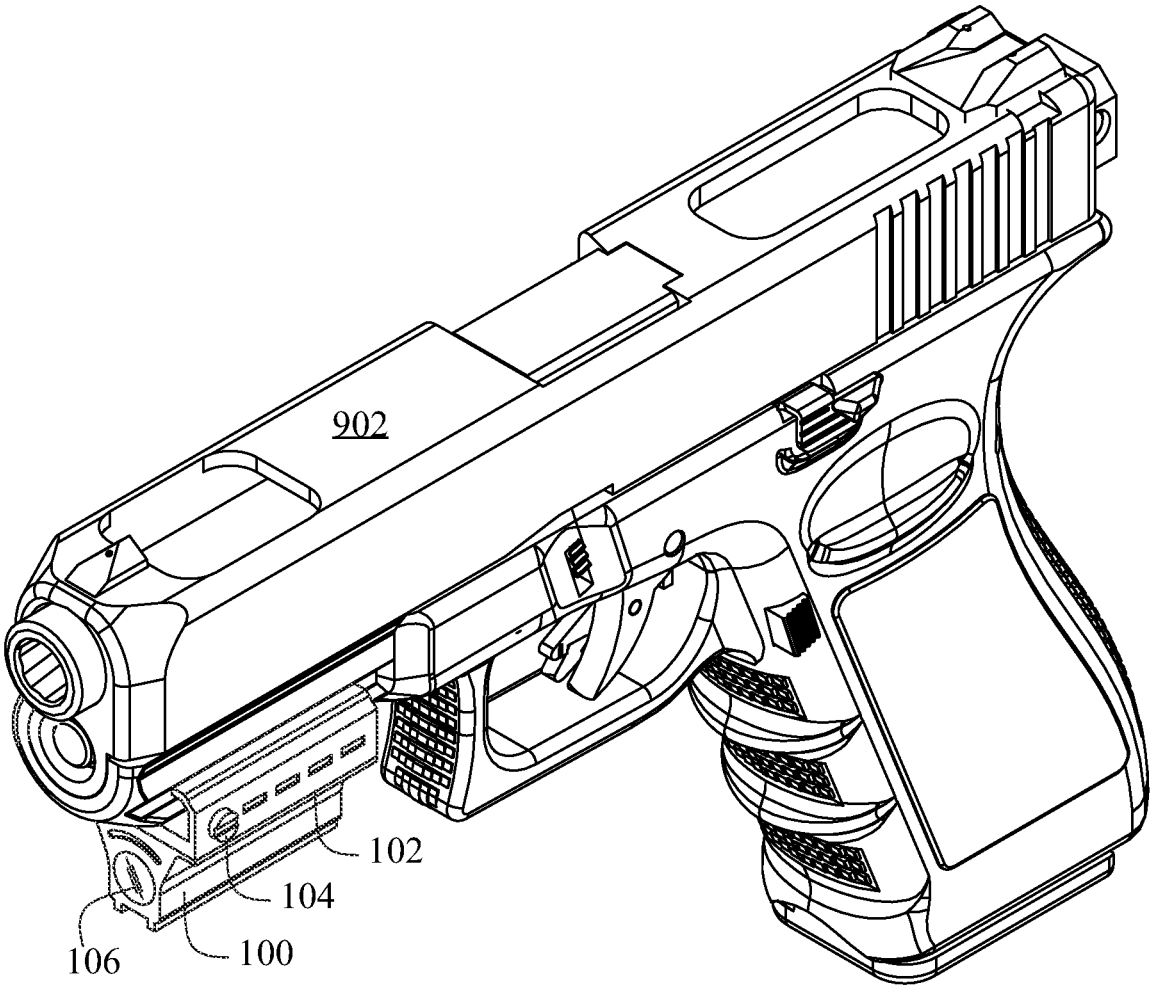
FIG. 10 illustrates a perspective view of an improved firearm laser sight mounted on an exemplary pistol, in accordance with aspects of the present disclosure.

The illustrations of FIGS. 9 and 10 illustrate an improved firearm laser sight mounted on exemplary firearms. The improved firearm laser sight may be designed for mounting on a rifle with a rail mount system 900, such as is shown in FIG. 9, a pistol with a rail mount system 902, such as is shown in FIG. 10, shotguns with barrel mount systems, or any other standardized firearm combination.

As before, disclosed herein is an improved firearm laser sight. The laser sight is an improvement to other laser sights because it utilizes laser patterns instead of a single dot. The laser sight may use a pattern generating element 200, 400 which may be a diffractive optical element (DOE) configured to diffract a laser beam into a desirably large and clear image projected onto surfaces, maintaining its clarity and purpose on uneven or skewed surfaces and for long distances. Alternatively, a shadow mask may be used to create an image. One of more lenses may be used to collimate the laser beam to adjust the size of the image. Patterns or images may include concentric circles, delta, chevron or any other shapes effective as a firearm sight. The laser sight device may be used as an accessory for various types of firearms. The invention may be configured such that an image is not significantly skewed if projected on an angled target.

The disclosed sight may be used in firearms such as rifles 900 and pistols 902 to show precisely where a single projectile will hit at a time, not merely a generalized circular area where a group of projectiles may possibly hit within simultaneously, which is a limitation in the prior art.

The sight is intended for quick visual acuity to acquire a sight on the intended target. The sight produces a complete or unbroken shape(s) or image(s) (e.g., a triangle may be projected via three uninterrupted clean lines). These shapes will quickly draw a user's eyes to a center of the projected shape or image to show precisely where individual bullets will strike the target, not merely what general area a shotgun blast covers. For projecting complete, unbroken shapes or images, a significantly higher powered laser (compared to prior sights) may be needed to keep the image bright since a single original beam is being spread out much more than just a group of dots or beams. Such a higher power laser may likely need a passive (or active) cooling component through possibly a built in heat sink. The sight will minimize the angle of the projected beams and so minimize the spread of the image so that the spreading or expanding is not significantly noticeable either at further distances or on angled surfaces. For example, the angle of projection may be five times less than a typical shotgun blast spread.

The sight may include a capacitive touch switch built in. For example, the housing may be made either entirely or partially made of a conductive metal which when touched may turn on the device when touched. An electrical timer may automatically turn the device off after a set time unless the device was turned off manually through a switch or button. If the firearm that the gun is attached to is constructed of a conductive metal, then simply touching the firearm itself may also turn the device on.

The sight may include emanating one or more beams through the use of Airy beams created by a pattern generating element 200, 400, e.g., a diffractive optical element (DOE), a series of lenses, and/or a crystal display. For example, the sight may be constructed in such a way that the beam appears to curve out from the side of the housing so that the image the sight creates can be larger than the housing from which it originates, yet does not grow over distance. In other words, the image the sight projects may be constant in size despite distance from the target. For example, an ideal Airy beam may have a cross section that has an area of principal intensity and multiple less luminous areas adjacent to one another which trail off to infinity. The beam may have a finite composition and be truncated. An Airy beam may propagate without diffracting (i.e., without spreading out). An airy beam may freely accelerate, or bend to form a parabolic arc.

Figure 11:
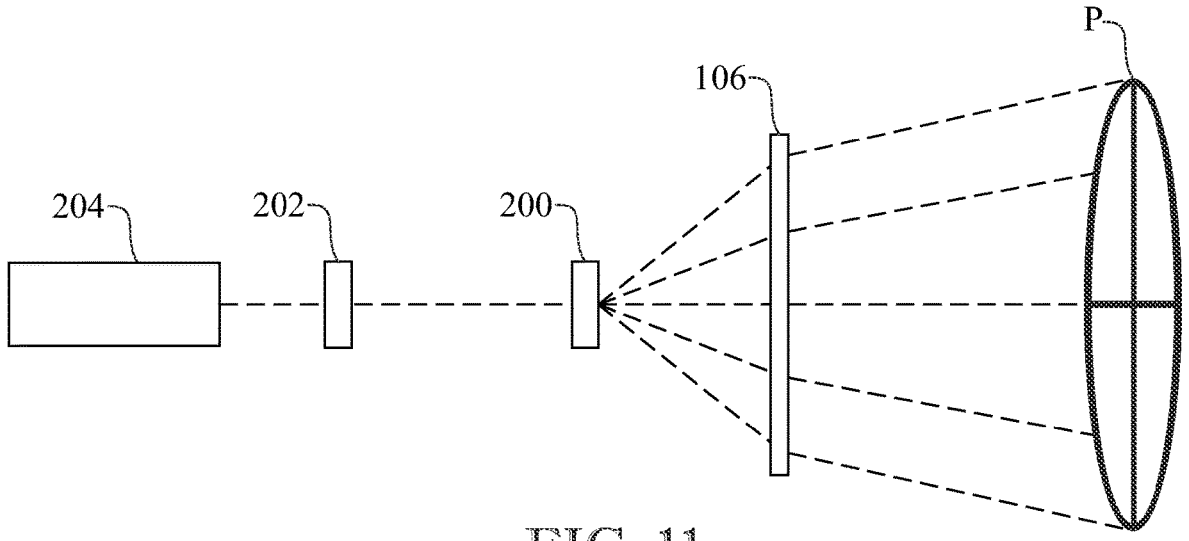
FIG. 11 is a schematic representation of a light source and optical elements of an illustrative embodiment of an improved firearm laser sight wherein a spread angle of light beams forming a pattern emanating from a pattern generating element is greater than a spread angle of light beams forming the pattern emanating from a focusing lens, in accordance with aspects of the present disclosure.

Turning next to the illustrative embodiment of FIG. 11, presented therein is a schematic representation of a light source 204 and optical elements 202, 200, 106 of an illustrative embodiment of an improved firearm laser sight wherein a spread angle of light beams forming a pattern (P) emanating from a pattern generating element 200 is greater than a spread angle of light beams forming the pattern (P) emanating from a focusing lens 106, in accordance with at least one embodiment of the present invention. More in particular, and as shown best in FIG. 11, an increase in the size of the pattern (P), which is proportional to the spread angle, emanating from the focusing lens 106 occurs at a much smaller rate over distance as compared to the increase in the size of the pattern (P) emanating from the pattern generating element 200 over a distance. Thus, in such an embodiment a pattern (P) enlarges slowly over distance so that the pattern (P) remains easily clear and visible at longer distances.

Figure 12:
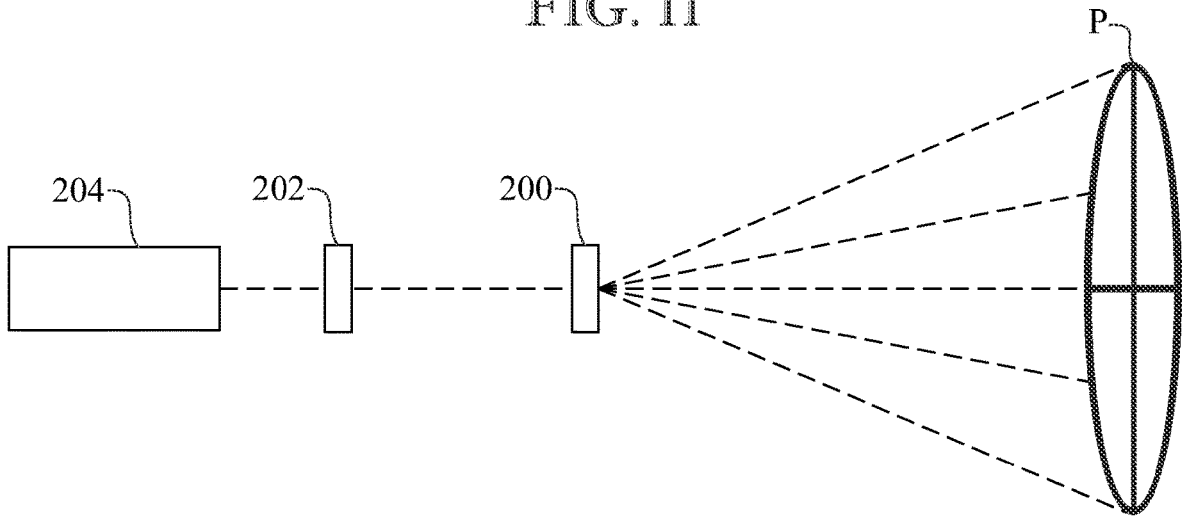
FIG. 12 is a schematic representation of a light source and optical elements of an illustrative embodiment of an improved firearm laser sight which is operative to project light beams forming a pattern from a pattern generating element without a focusing lens, in accordance with aspects of the present disclosure.

With reference to FIG. 12, a schematic representation of a light source 204 and optical elements 202 and 200 of an illustrative embodiment of an improved firearm laser sight is presented. Of note, the improved firearm laser sight is operative to project light beams forming and projecting a pattern (P) directly from a pattern generating element 200, without utilizing a focusing lens 106. More in particular, in at least one embodiment, a pattern generating element 200 is configured such that the spread angle of light beams forming a pattern (P) emanating directly from the pattern generating element 200 is such that a substantially large clear image is projected out from the sight and focused such that the projected image or pattern (P) does not get too large or too small over long distances, maintaining an appropriate size, brightness, and clarity as optimal to a human user over short and long distances.

Figure 13:
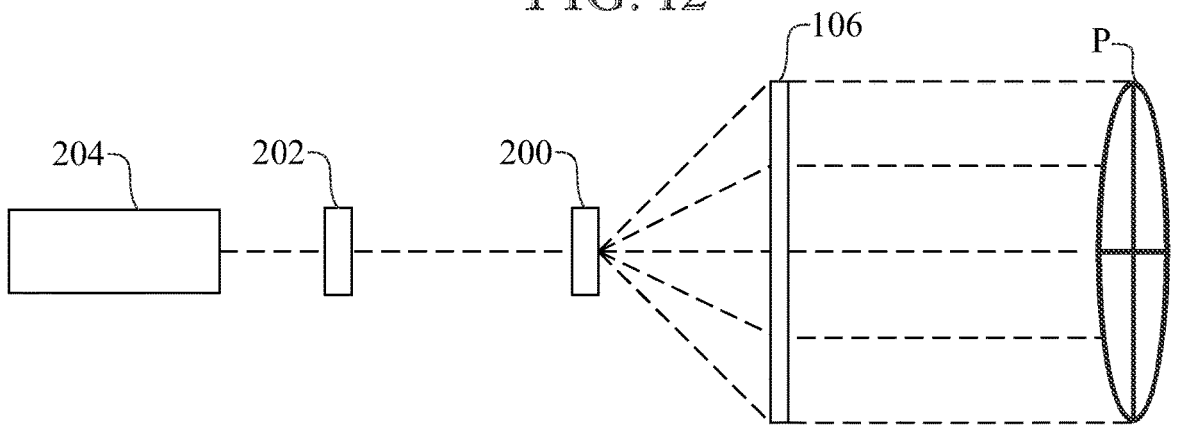
FIG. 13 is a schematic representation of a light source and optical elements of an illustrative embodiment of an improved firearm laser sight wherein light beams forming a pattern emanating from a focusing lens are parallel with one another, in accordance with aspects of the present disclosure.

FIG. 13 is illustrative of a schematic representation of a light source 204 and optical elements 202, 200, 106 of an illustrative embodiment of an improved firearm laser sight wherein light beams forming a pattern (P) emanating from a focusing lens 106 are parallel with one another so that there is little to no enlargement of the pattern (P) over distance, such that the pattern (P) remains clear and readily visible at longer distances.

Figure 14:
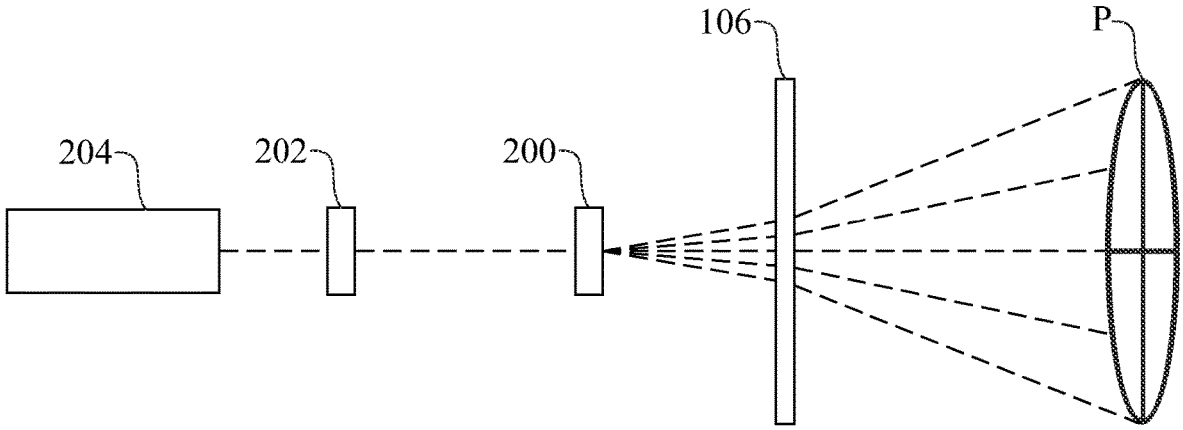
FIG. 14 is a schematic representation of a light source and optical elements of an illustrative embodiment of an improved firearm laser sight wherein a spread angle of light beams forming a pattern emanating from a focusing lens is greater than a spread angle of light beams forming the pattern emanating from a pattern generating element, in accordance with aspects of the present disclosure.

Looking next to the illustrative embodiment of FIG. 14, presented therein is a schematic representation of a light source 204 and optical elements 202, 200, 106 of an improved firearm laser sight wherein a spread angle of light beams forming a pattern (P) emanating from a focusing lens 106 is greater than a spread angle of light beams forming the pattern (P) emanating from a pattern generating element 200, such as may be beneficial when a prospective target is in closer proximity to a user and the firearm itself.

Figure 15:
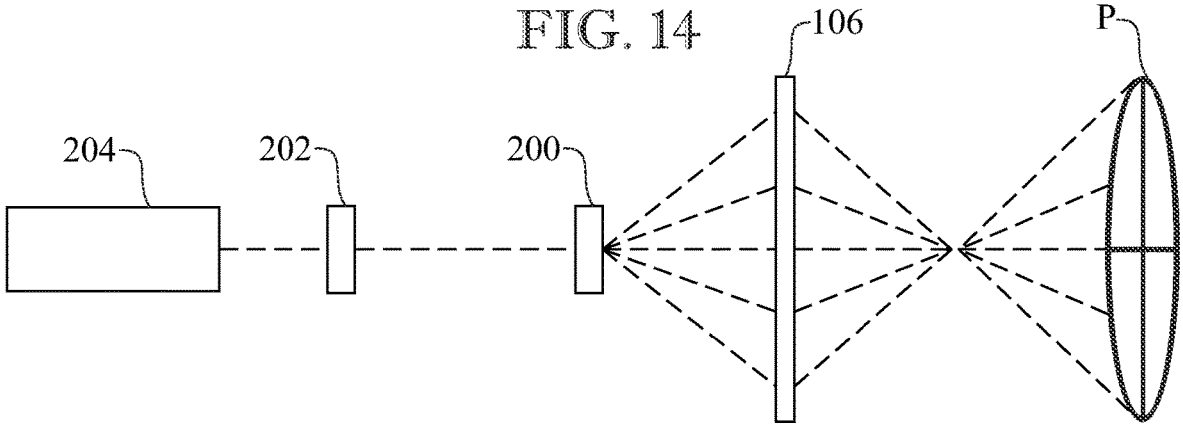
FIG. 15 is a schematic representation of a light source and optical elements of an illustrative embodiment of an improved firearm laser sight wherein light beams forming a pattern emanating from a focusing lens converge and are inverted, in accordance with aspects of the present disclosure.

FIG. 15 is a schematic representation of a light source 204 and optical elements 202, 200, 106 of one further illustrative embodiment of an improved firearm laser sight wherein light beams forming a pattern (P) emanating from the focusing lens 106 converge and are inverted. Such an embodiment is useful in situations where a prospective target is a greater distance form the user and the firearm as it allows for the size, and thus the clarity, of the pattern (P) to be maintained across nearly twice the distance it would in a configuration wherein the spread angle of the light beams emanating from the focusing lens 106 forming the pattern (P) were continually diverging and expanding.

Figure 16A:
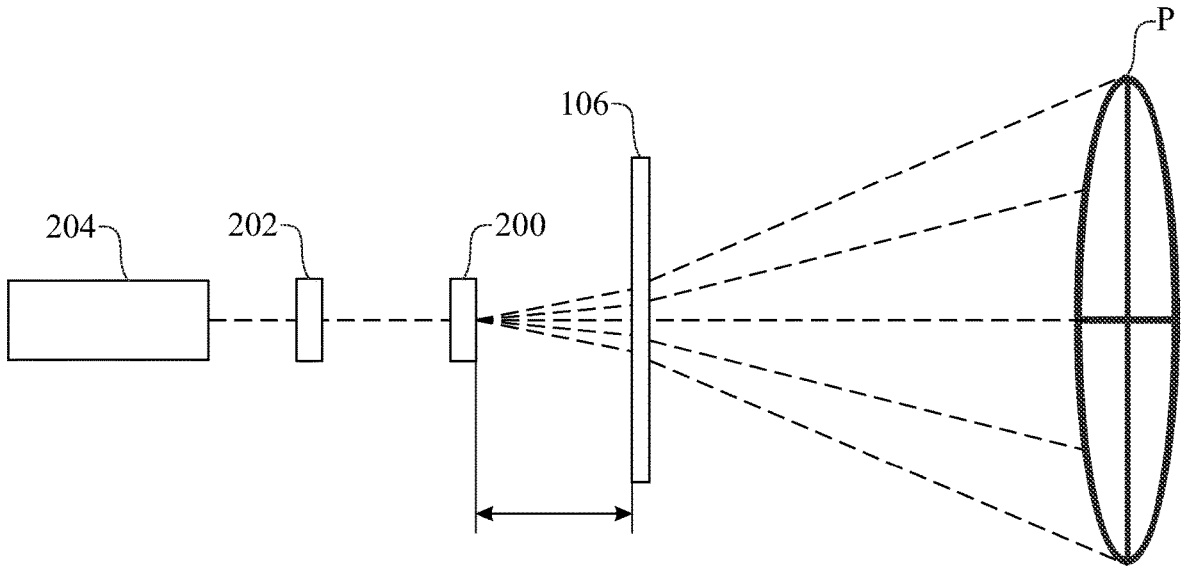
FIGS. 16A and 16B are schematic representation of a light source and optical elements of an illustrative embodiment of an improved firearm laser sight wherein a spread angle of light beams forming a pattern emanating from a focusing lens is varied based upon positioning of a pattern generating element relative thereto, in accordance with aspects of the present disclosure.
Figure 16B:
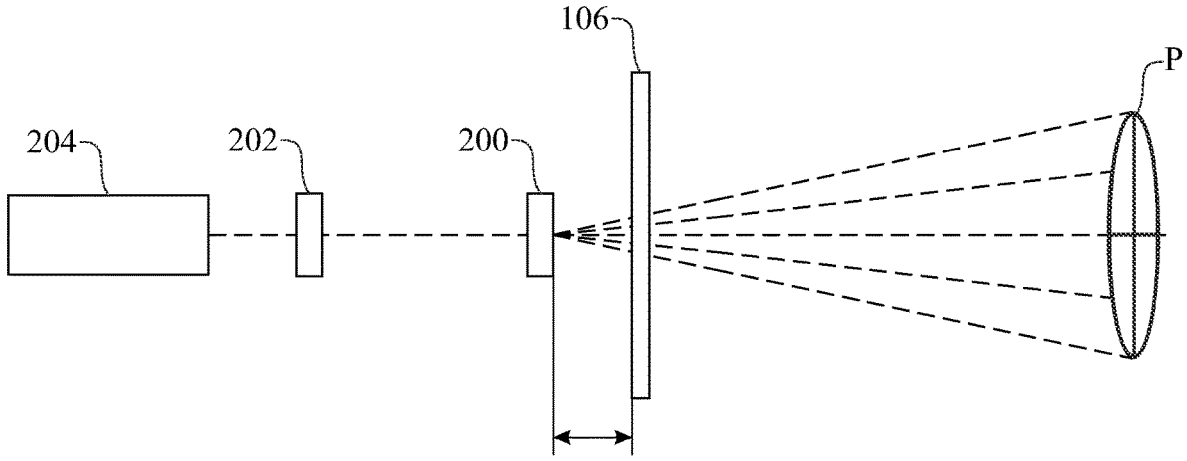

FIGS. 16A and 16B present schematic representations of a light source 204 and optical elements 202, 200, 106 of an illustrative embodiment of an improved firearm laser sight wherein a spread angle of light beams forming a pattern (P) emanating from a focusing lens 106 is varied based upon positioning of a pattern generating element 200 relative thereto. More in particular, as seen in the illustrative embodiment of FIG. 16A, when the pattern generating element 200 is positioned further from the focusing lens 106, a spread angle of light beams forming a pattern (P) emanating from the focusing lens increases. Conversely, as shown in the illustrative embodiment of FIG. 16B, when the pattern generating lens 200 is positioned closer to the focusing lens 106, a spread angle of light beams forming a pattern (P) emanating from the focusing lens becomes smaller. As will be appreciated, by providing a variably positionable pattern generating element 200, such as is also shown by way of example in FIGS. 4 and 5, a user may optimize a size of a pattern (P) to be projected onto a prospective target, regardless of the distance between the user and the firearm, and the prospective target itself. As will be further appreciated, by moving optical elements 202, 200, 106 closer or further from one other, a spread angle of light beams forming the pattern (P) emanating from the present improved firearm laser sight will increase or decrease, depending on the type of optical elements employed, their focal lengths, and the angle of the incoming light beams, among other factors.

Since many modifications, variations, and changes in detail can be made to the described embodiments or examples of the invention, it is intended that all matters in the foregoing description and shown in the accompanying drawings be interpreted as illustrative and not in a limiting sense. Thus, the scope of the invention should be determined by the appended claims and their legal equivalents.

What is claimed is:

1. A firearm laser sight releasably mountable to a portion of a firearm to facilitate aligning a trajectory of a bullet fired from the firearm to a selected target, said firearm laser sight comprising:

a main housing having a mounting adapter which interconnects said firearm laser sight to the portion of the firearm;

a visible laser light source generates a visible laser light beam therefrom;

a collimating lens optically receives said visible laser light beam from said visible laser light source;

a pattern generating element focuses said visible laser light beam and projects a sight pattern therefrom; and a focusing lens focuses said sight pattern and projects said sight pattern onto the selected target.

2. The firearm laser sight as recited in claim 1, wherein said pattern generating element is a diffractive optical element.

3. The firearm laser sight as recited in claim 1, wherein said pattern generating element is a shadow mask.

4. The firearm laser sight as recited in claim 1, wherein said visible laser light source generates a pulsed visible laser light beam therefrom to reduce a perceived shakiness of a projected image.

5. The firearm laser sight as recited in claim 1, wherein said focusing lens is aspherical.

6. The firearm laser sight as recited in claim 1, wherein said focusing lens is spherical.

7. The firearm laser sight as recited in claim 1, wherein said focusing lens is a Fresnel lens.

8. The firearm laser sight as recited in claim 1, further comprising an Airy beam technology to further reduce said spread of said sight pattern projected on the selected target.

9. A firearm laser sight releasably mountable to a portion of a firearm to facilitate aligning a trajectory of a bullet fired from the firearm to a selected target, said firearm laser sight comprising:

a main housing having a mounting adapter which interconnects said firearm laser sight to the portion of the firearm;

a visible laser light source generates a visible laser light beam therefrom;

a collimating lens receives said visible laser light beam from said visible laser light source;

a pattern generating element focuses said visible laser light beam and projects a sight pattern therefrom;

a focusing lens focuses said sight pattern and projects said sight pattern onto the selected target; and said pattern generating element positionable within said main housing relative to at least said focusing lens such that a size of said sight pattern may be adjusted.

10. The firearm laser sight as recited in claim 9, wherein said size of said sight pattern is enlarged when said pattern generating element is positioned farther from said focusing lens.

11. The firearm laser sight as recited in claim 9, wherein said size of said sight pattern is reduced when said pattern generating element is positioned closer to said focusing lens.

12. The firearm laser sight as recited in claim 11, wherein said size of said sight pattern is enlarged when said pattern generating element is positioned farther from said focusing lens.

13. The firearm laser sight as recited in claim 9, wherein said pattern generating element is a diffractive optical element.

14. The firearm laser sight as recited in claim 9, wherein said pattern generating element is a shadow mask.

15. The firearm laser sight as recited in claim 9, wherein said focusing lens is aspherical.

16. The firearm laser sight as recited in claim 9, wherein said focusing lens is spherical.

17. The firearm laser sight as recited in claim 9, wherein said focusing lens is a Fresnel lens.

18. The firearm laser sight as recited in claim 9, further comprising a plurality of pattern generating elements each configured to generate a different one of a plurality of sight patterns therefrom.

19. The firearm laser sight as recited in claim 9, wherein said mounting adapter dimensioned and configured to releasably interconnect said firearm laser sight to the portion of the firearm.

20. A firearm laser sight releasably mountable to a portion of a firearm to facilitate aligning a trajectory of a bullet fired from the firearm to a selected target, said firearm laser sight comprising:

a main housing having a mounting adapter which interconnects said firearm laser sight to the portion of the firearm;

a visible laser light source generates a visible laser light beam therefrom;

a collimating lens optically receives said visible laser light beam from said visible laser light source;

a pattern generating element focuses said visible laser light beam and projects a sight pattern therefrom; and said pattern generating element focuses said sight pattern and projects said sight pattern onto the selected target.

* * * * *